US006102406A

United States Patent [19]

Miles et al.

[11] Patent Number: 6,102,406

[45] Date of Patent: Aug. 15, 2000

[54] INTERNET-BASED ADVERTISING SCHEME EMPLOYING SCAVENGER HUNT METAPHOR

[75] Inventors: Steven A. Miles, Sherman Oaks; G. Michael Wool, Los Angeles, both of Calif.

[73] Assignee: Steven A. Miles, Sherman Oaks, Calif.

[21] Appl. No.: 09/326,871

[22] Filed: Jun. 7, 1999

[51] Int. Cl.[7] ..... A63F 9/18

[52] U.S. Cl. ..... 273/430; 463/9; 434/322; 434/323; 434/350

[58] Field of Search ..... 273/430, 454; 434/322, 323, 350; 463/9

[56] References Cited

U.S. PATENT DOCUMENTS 5,679,075 10/1997 Forrest et al. ..... 463/9
5,942,969 8/1999 Wicks ..... 340/286.02 X

*Primary Examiner*—Jessica J. Harrison
*Assistant Examiner*—Chanda Harris
*Attorney, Agent, or Firm*—Blakely, Sokoloff Taylor & Zafman LLP

[57] ABSTRACT

An Internet-based service configured to operate a scavenger hunt in which participants are required to answer questions using information obtained from one or more Web sites visited in response to hints suggesting where such information may be located. Each preceding question must be successfully answered before a next question is presented. Generally, a correct answer requires verification that a respondent visited the Web site at which the information required in the answer is located. This, in turn, may require that the respondent reached the Web site at which the information required in the answer is located through an authorized path including at least one predetermined Web address. Such verification may be achieved by using referring uniform resource locator (URL) information regarding the at least one Web address as a security key to allow access to a location at which the respondent may enter the answer. The security key provides access to a secure database used to store answers provided by the participants in the scavenger hunt. Unique security keys for each question used in the scavenger hunt may be required to obtain access to the secure database.

25 Claims, 15 Drawing Sheets

Internet Treasure Hunt(sm)

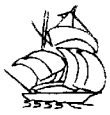

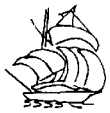

INFOSEARCH, Inc.

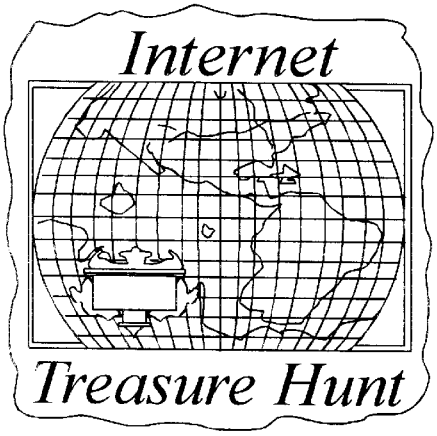

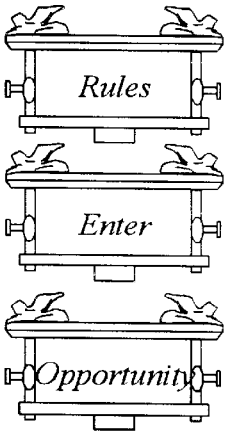

Here's your chance to win prizes by searching for treasure on the Internet.

Before you get started please take a chance to read the rules.

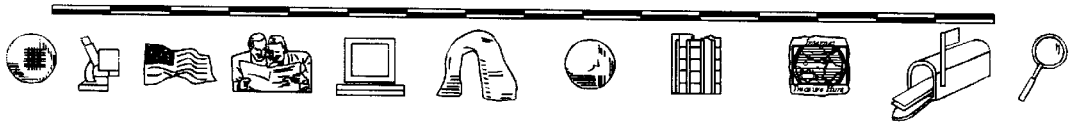

Infosearch reserves the right to not include any listing. Inclusion in INFOSEARCH should not be construed as an endorsement. All trademarks and registered trademarks are used to benefit and without intent to infringe on the mark holder.

The salesmarked name of "Internet Treasure Hunt(sm) and "InternetTreasureHunt.com"
©All Rights Reserved Worldwide
1997-1999

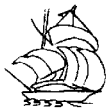

INFOSEARCH,Inc.
P.O. 540392
North Salt Lake, UT 84054-0392
(801) 296-6360

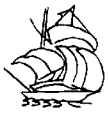

FIG. 2A
(Prior Art)

Internet Treasure Hunt(sm) - Rules

INFOSEARCH, Inc.

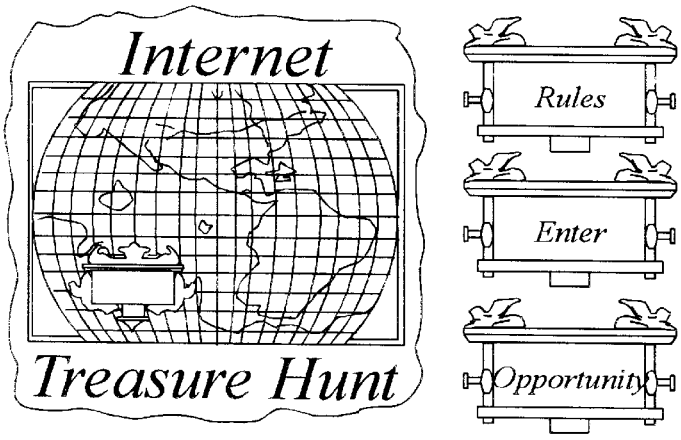

Here's your chance to win prizes by searching for treasure on the Internet.

Please take a moment to read the rules listed below and then go to the entry form to find out where you will be going and what questions you'll need to answer.

- Random drawings will be done from all correct entries for prizes from participating sponsors as well as the INFOSEARCH prize chest.
- No purchase necessary to enter.
- All questions must be answered correctly to be eligible for prize drawings.
- All taxes, customs fees, etc. are the responsibility of the winner.
- By entering you are giving INFOSEARCH,Inc. and sponsors the permission to use your name, comments and likeness in promotional material without compensation.
- Prizes should arrive to winners 4-6 weeks after each drawing. (Sorry, not everyone can win!)
- Employees and families of INFOSEARCH, Inc. and sponsors are ineligible for prize drawings.
- Decisions of the judges are final.
- Prizes cannot be substituted and are not redeemable for cash.
- Void where prohibited by law.

http://www.internettreasurehunt.com/rules.html

FIG. 2B
(Prior Art)

Internet Treasure Hunt(sm) - Rules

•Please tell a friend about the Internet Treasure Hunt(sm) and Have Fun!!

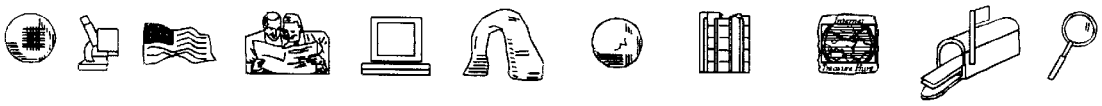

Infosearch reserves the right to not include any listing. Inclusion in INFOSEARCH should not be construed as an endorsement. All trademarks and registered trademarks are used to benefit and without intent to infringe on the mark holder.

The salesmarked name of "Internet Treasure Hunt(sm) and "InternetTreasureHunt.com"
©All Rights Reserved Worldwide
1997-1999

INFOSEARCH,Inc.
P.O. 540392
North Salt Lake, UT 84054-0392
(801) 296-6360

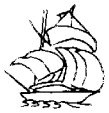

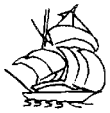

FIG. 2C
(Prior Art)

Internet Treasure Hunt(sm) - Entry Form

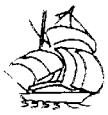

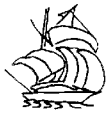

INFOSEARCH, Inc.

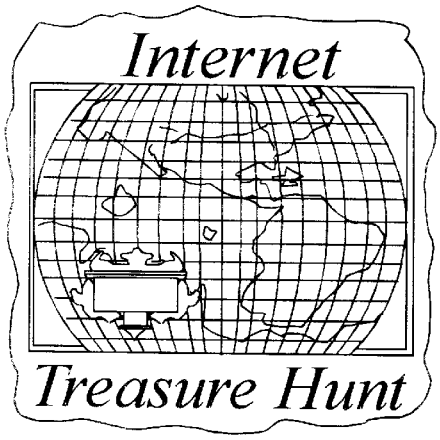

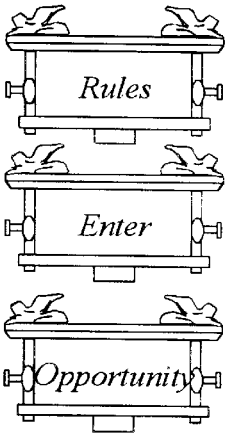

Search for info at the sponsoring sites and you could win fun prizes!
All answers can be found at the corresponding websites.

*Hint: the logo links provided make navigating the sites easy.*

You must answer ALL questions for your entry to be valid!
Identify information will only be used in shipping prizes.

What is your name?

What is your e-mail address?

Your gender:

☐ Male ☐ Female

Your age:

☐ 18-24 years old

☐ 25-34 years old

☐ 35-44 years old http://www.internettreasurehunt.com/enter.html

FIG. 2D
(Prior Art)

Internet Treasure Hunt(sm) - Entry Form

☐ 45-54 years old

☐ 55+ years old

Please let us know where to send your treasure if you win:

Street Address

City

State/Province

Zip or Postal Code

Country

Here are the questions for this installment of the internet treasure Hunt(sm)...

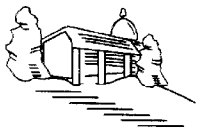

Which room at The Inn On Capital Hill is your favorite and why?

CONVERGYS

Convergys is one of the largest employers in Utah. According to the link on "Find It On The Net (sm)" how many network engineers is the Orem, Utah facility hiring?

○ 10

○ 50

○ 100

○ 150

According to the link on "Find It On The Net(sm)" who do you e-mail your resume to for the network engineer positions at the Orem, Utah facility?

Keane offers network training and certification at three Utah branches, downtown Salt Lake City, Provo and South Jordon. How many branch offices does Keane have across the U.S. and http://www.internettreasurehunt.com/enter.html FIG. 2E
(Prior Art)

Internet Treasure Hunt(sm) - Entry Form

Canada?

FIND IT ON THE NET.COM
INFOSEARCH, Inc. PRESENTS

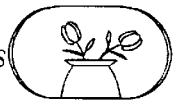

PC Flowers & Gifts Inc.™

Find It On The Net(sm) and PC Flowers provide 100% secure shopping of floral products. PC Flowers has been the leading online florist since_____?

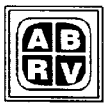

How many people are pictures in the Ardell Brown family photo?

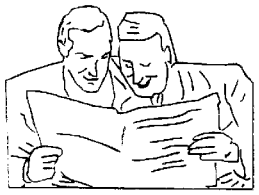

Mr. Smith
E-Mails
Washington

Following the link at Mr. Smith E-Mails Washington, how much is the movie "Mr. Smith Goes To Washington?"

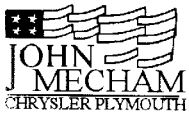

Visit the new car department at John Mecham Chrysler, Plymouth, Jeep and calculate the new car payment based on the following information:

- Vehicle price = $1995
- Trade in Wholesale = $5500
- Trade payoff = $0
- Additional money down = $2000
- Length of Terms = 60 months
- Interest Rate = 10.5% http://www.internettreasurehunt.com/enter.html

FIG. 2F
(Prior Art)

Internet Treasure Hunt(sm) - Entry Form

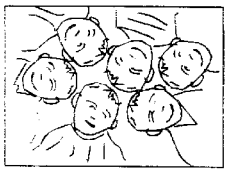

I FEEL LOVED WHEN MY PARENTS PRAISE ME. I FEEL LOVED WHEN MY MOM TUCKS ME IN. I FEEL LOVED WHEN MY PARENTS SPEND TIME WITH ME.
IT'S ALL ABOUT YOUR TIME & ATTENTION...
I FEEL LOVED WHEN Y DAD READS TO ME. I FEEL LOVED WHEN MY KIDS GIVE ME A HUG. I FEEL LOVED WHEN MY GRANDBABIES SIT ON MY LAP.

It's All About Your Time & Attention. In the UtahParent.com TV message available for download, what color shirt is the boy wearing that says,"I feel loved when my parents praise me...? "

XMISSION internet solutions provider

Xmission has links to "Net Recreation." Who are the makers of Quake and Doom?

How did you hear about the "Internet Treasure Hunt(sm)? "

How hard was this installment of the "Internet Treasure Hunt(sm)? "

- Way too easy
- Too easy
- Just right
- Too Hard
- Way too Hard

Here is my entry in the Internet Treasure Hunt

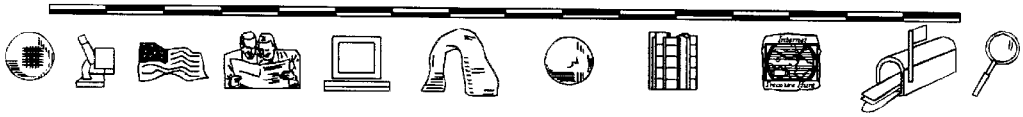

Infosearch reserves the right to not include any listing. Inclusion in INFOSEARCH should not be construed as an endorsement. All trademarks and registered trademarks are used to benefit and without intent to infringe on the mark holder.

The salesmarked name of "Internet Treasure Hunt(sm) and "InternetTreasureHunt.com"
©All Rights Reserved Worldwide
1997-1999

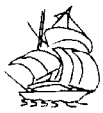

INFOSEARCH,Inc.
P.O. 540392
North Salt Lake, UT 84054-0392
(801) 296-6360

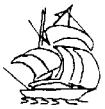

http://www.internettreasurehunt.com/enter.html

FIG. 2G
(Prior Art)

Internet Treasure Hunt(sm) - Sponsorship Opportunities

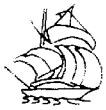

INFOSEARCH, Inc.

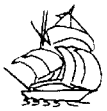

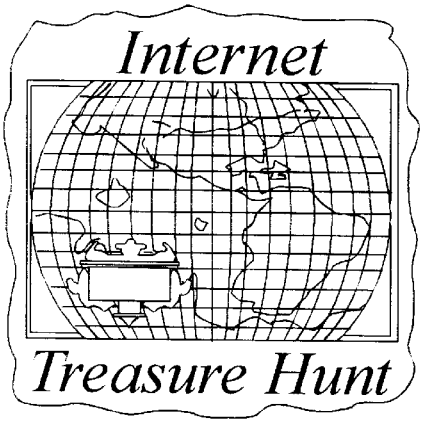

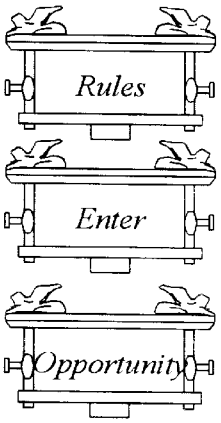

How would you like to have people really "search" your website?

We're talking about more than just a simple click and leave, we mean go through your site and get some relevant "info".

Sponsors receive a customized logo-link entry page and at least one (1) "Internet Treasure Hunt(sm)" question whose answer is available somewhere on their site. A couple of things to consider...

- Sponsoring sites all pay a promotional fee.
- Sponsors have the option of providing prizes ot an additional promotional fee for the "Internet Treasure Hunt(sm)"
- All prizes must be pre-approved and received by INFOSEACH before a sponsoring site will be added
- All sponsoring sites are required to put the "Internet Treasure Hunt(sm)" graphic prominently on their site. The html code for the button will be provided to point at the INFOSEARCH server. This will speed the loading of the graphic as people go from site to site searching for treasure.

What is your name?

http://www.internettreasurehunt.com/opportunity.html

FIG. 2H
(Prior Art)

Internet Treasure Hunt(sm) - Sponsorship Opportunities

What is your electronic mail address?

Please let us know about your business:

Company

Address

City

State/Prov

Zip Code

Country

Phone

What is the URL for your website?

What prize(s) would your business be able to contribute to the "Internet Treasure Hunt (sm)"?

How did you hear about the "Internet Treasure Hunt(sm)? :

I want more info about being a sponsor of the Internet Treasure Hunt.

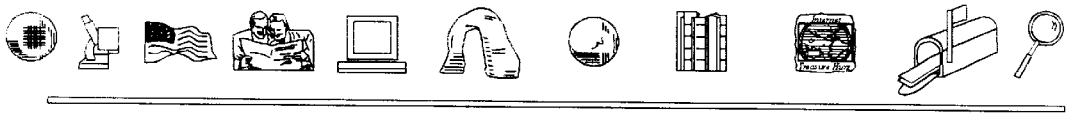

Infosearch reserves the right to not include any listing. Inclusion in INFOSEARCH should not be construed as an endorsement. All trademarks and registered trademarks are used to benefit and without intent to infringe on the mark holder.

The salesmarked name of "Internet Treasure Hunt(sm) and "InternetTreasureHunt.com"
©All Rights Reserved Worldwide
1997-1999

INFOSEARCH,Inc.
P.O. 540392
North Salt Lake, UT 84054-0392
(801) 296-6360 http://www.internettreasurehunt.com/opportunity.html

FIG. 2I
(Prior Art)

INTERNET-BASED ADVERTISING SCHEME EMPLOYING SCAVENGER HUNT METAPHOR

FIELD OF THE INVENTION

The present invention relates to a generalized method for advertisement on the Internet that departs from conventional banner advertisements. More particularly, the present advertising model adopts a scavenger hunt approach that provides an interactive interface through which participants are invited to "click through" to advertiser/sponsor Web sites in order to determine answers to questions posed by a scavenger hunt advertising service provider.

BACKGROUND

Current mechanisms of advertising on the Internet largely involve banner advertisements ("banner ads"). In this model, a graphic image containing text or images is rendered on a portion of a display while a user is viewing some other Internet-based content. An example of such an advertising model is shown in FIG. 1. This example illustrates how a banner ad 10 might be viewed by a user through an Internet browser (i.e., computer software configured to render hypertext markup language (HTML) and other code in human-readable form). Such a banner ad 10 might be rendered as part of the results from a search engine query. That is, while the search engine results are being displayed, a banner ad occupying some portion of the user's display area 12 is rendered as an advertisement for a sponsoring entity. This sponsoring entity, in some cases, could be related to the search engine results.

In general banner ads provide "impressions" to viewers. In this regard, they are similar to billboard advertisements displayed to passing motorists. Usually, advertisers pay a fixed amount to Internet site operators for the right to have their logo or banner ad displayed on the site. The pricing model is generally based on the number of "viewings" or "impressions" that the banner has, per day.

Usually, the goal of the advertiser sponsoring the banner ad is to entice the viewer to "click through" (i.e., to select the ad using a cursor control device) to the advertiser's Web site. Thus, the banner ad can be linked through a uniform resource locator (URL) to another site (usually the advertiser's site) on the Internet. By moving a mouse, pen or other selecting object over the banner ad and clicking on the advertisement, the viewer is routed to the associated Web site. This is referred to as a "click through" and results in the transfer of the viewer from the the original site at which the banner ad was displayed to the new site. With existing advertising models, advertisers often pay additional sums to the sponsor sites when viewers of the banner ads "click through" to the advertiser's site.

Unfortunately, and as is the case for impression advertisements on television and billboards, the "click through" rates for banner ads are quite low. Recent estimates suggest that the upper bounds for most banner ads is an approximately 2% "click through" rate. Thus, at an Internet site that may have as many as a million visitors per day, as few as 2000 of those visitors will actually click through on a given banner ad. This extremely low rate of conversion of "impression" to "click through" results in a very poor linkage between the banner ad and the ultimate product purchase that is often the desired goal.

Recently, a new form of advertising has found its way to the Internet. This new form of advertising makes use of a scavenger hunt model, but it should be recognized that existing implementations of this advertising form are not necessarily prior art to the present invention. One such scavenger hunt advertising site may be found at www.internettreasurehunt.com.

In this new advertising model, the hosting site (e.g., internettreasurehunt.com) sponsors a treasure or scavenger hunt in which participants are asked to provide answers to questions. The intent of the hosting site operators is to direct participants to advertiser Web sites in order to locate the answers to these questions. Presumably, after visiting the advertiser sites and gathering the information necessary to complete the answers, the participants will then return to the hosting site and submit their responses to the questions. At the end of the game, a winner is chosen and prizes (which were the original incentive to visit the advertiser sites) are awarded.

To better understand this advertising model, consider the illustrations shown in FIGS. 2A–2J. These illustrations are actual screen shots from the internettreasurehunt.com Web site, downloaded Apr. 23, 1999, and are provided in their entirety to help differentiate the scavenger hunt scheme envisioned by the owners of that site from the present scheme.

FIG. 2A illustrates the home page of internettreasurehunt-.com. That is, the Web page first presented to visitors to the site. The Web page invites viewers to participate in the "Treasure Hunt" by first reading the rules of the game. These rules are set forth in the illustrations provided at FIGS. 2B and 2C. Most notably, the rules do not require a participant to actually visit any advertisers' sites, merely that participants correctly answer the questions set forth.

FIGS. 2D–2G are screen shots of the "entry form" used by internettreasurehunt.com. After soliciting some personal and contact information, the site operators provide the participant with a series of questions, each having a separate answer space. The entry form is thus arranged as a Web form having various entry fields for completion by a participant. Note, although several Figures are needed to display this Web form in its entirety, the form is displayed as a single Web page when viewed using a browser.

Notice that associated with each question is a link (usually in the form of a graphic link) to a sponsor/advertiser site at which the answer to the question may presumably be located. For example, in FIG. 2E, the first question seeks to determine a participant's favorite room at a certain inn and a link to a Web site describing that inn is provided immediately before the question. This is intended to prompt the participant to visit the inn owner's Web site to look for a favorite room. Upon completion of this task, the participant can answer the question posed.

Similar questions and advertiser/sponsor links exist for all advertisers participating in the Treasure Hunt game. By reviewing FIGS. 2E through 2G, one can see that a participant is presented with all of the questions for the game at the same time. Moreover, all of the sites at which the answers can be found are prominently displayed next to the questions. Upon answering the questions, a participant can submit his/her answers using the submission button at the bottom of the form.

The internettreasurehunt.com operators apparently believe that the scavenger hunt metaphor they have adopted will have viewers actually "search" ad advertiser's Web site. At least this belief is manifest on a "Sponsorship Opportunities" page of the site, as shown in FIGS. 2H–2J. Here, the site operators are apparently giving advertisers the chance to become sponsors by submitting their relevant contact and Web site information (again through the use of a Web form). Although it is possible that the scavenger hunt model may attract more viewers to an advertiser's site than would a banner ad, there are flaws in the approach adopted by the operators of internettreasurehunt.com.

For example, by listing all of the questions on a single page, the operators of internettreasurehunt.com run the risk that an unscrupulous participant will distribute these questions among several cohorts, with each being responsible for rounding up some of the answers. Then, each of these participants might share answers with one another (or even post the answers to newsgroup sites or elsewhere), thus defeating the intent of the site operators and advertisers that each participant individually visit each advertiser site. Indeed, nowhere does it appear that the operators of internettreasurehunt.com have given any consideration to this problem. No requirement that individuals actually visit the participating advertiser/sponsor sites is set forth and no means of checking whether such visiting actually occurs is indicated. As a result, potential advertisers are not guaranteed that game participants will actually visit their respective sites and the value of the advertising scheme to potential sponsors is therefore questionable.

SUMMARY OF THE INVENTION

In one embodiment, an Internet-based service configured to operate a scavenger hunt in which participants are required to answer questions using information obtained from one or more Web sites visited in response to hints suggesting where such information may be located is provided. Each preceding question must be successfully answered before a next question is presented. Generally, a correct answer requires verification that a respondent visited the Web site at which the information required in the answer is located. This, in turn, may require that the respondent reached the Web site at which the information required in the answer is located through an authorized path including at least one predetermined Web address. Such verification may be achieved by using referring uniform resource locator (URL) information regarding the at least one Web address as a security key to allow access to a location at which the respondent may enter the answer. The security key provides access to a secure database used to store answers provided by the participants in the scavenger hunt. Unique security keys for each question used in the scavenger hunt may be required to obtain access to the secure database.

BRIEF DESCRIPTION OF THE DRAWINGS

The present invention is illustrated by way of example, and not limitation, in the figures of the accompanying drawings in which like reference numerals refer to similar elements and in which:

FIGS. 2A–2J illustrate pages from the Internet Web site www.intenettreasurehunt.com, wherein FIG. 2A illustrates the home page of that site, FIGS. 2B and 2C illustrate the "Rules" page of that site, FIGS. 2D–2G illustrate the "Entry Form" page of that site, and FIGS. 2H–2J illustrate the "Sponsorship Opportunities" page of that site;

DETAILED DESCRIPTION

Figure 1:
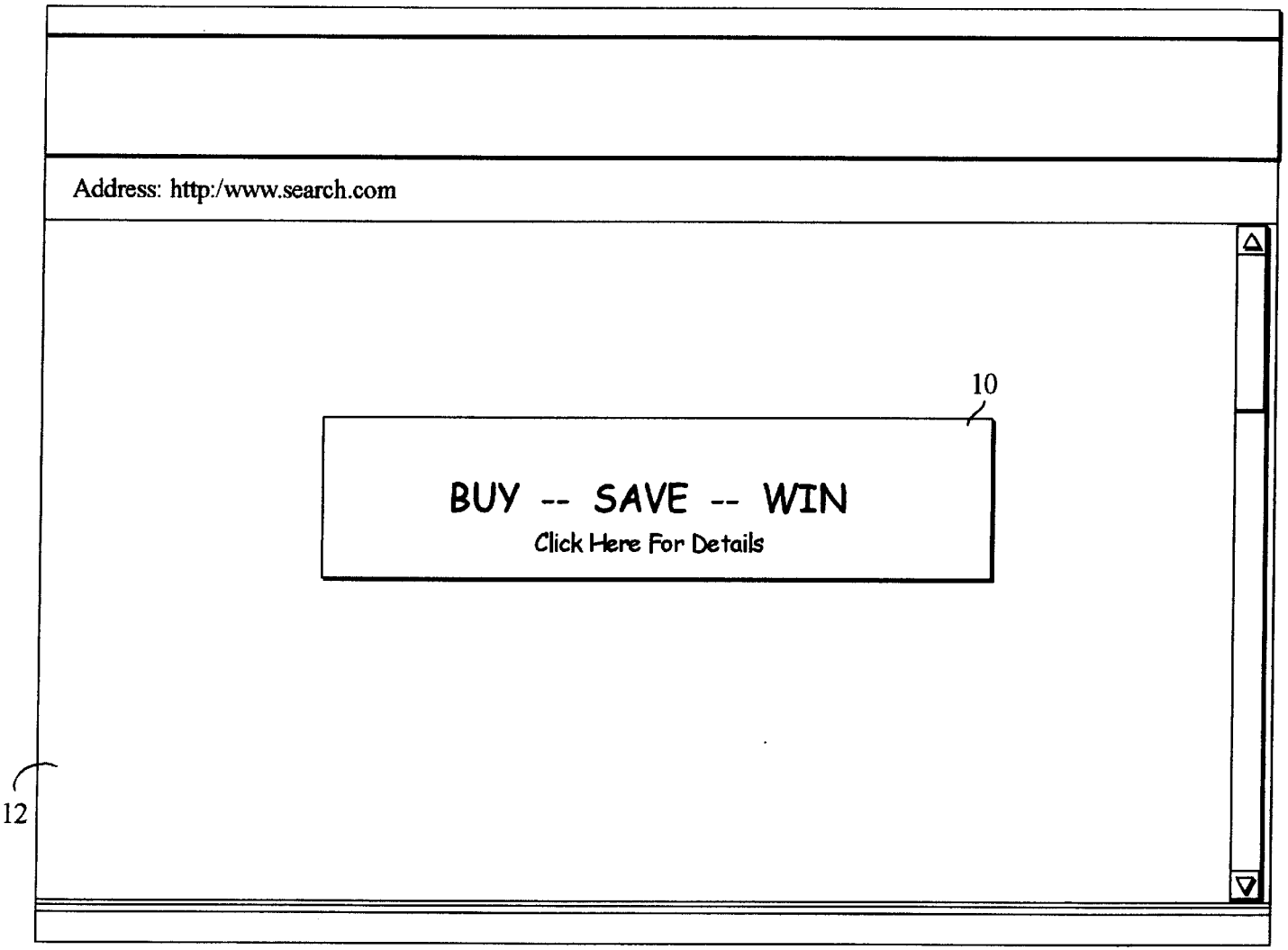
FIG. 1 illustrates an example of a banner ad as it might appear on a display of a computer system.

Disclosed herein is a generalized method for advertisement on the Internet that is designed to increase the delivery of viewers to specific Internet sites. In contrast to banner ads, the present advertising model requires individuals thoroughly investigate a site looking for specific information (e.g., to complete answers to questions posed as part of a scavenger hunt). In other words, figuratively speaking, instead of a participant driving a automobile and viewing billboards (banner ads), in the present scheme a viewer is invited into an automobile that drives him or her to a particular store. Thus, "click through" rates for each "impression" are significantly increased over that achieved using banner ads.

As indicated above, the present scheme involves the development of a modified scavenger hunt on the Internet. In this model, advertisements or the postings of desirable content are used to entice a participant to visit to a hosting Internet site for enrollment in the scavenger hunt. Once at the scavenger hunt host location, the rules of the game along with a first question and clue(s) regarding one or more locations where the answer thereto may be found are provided to the participant. The participant must then successfully find the required information on the Internet or other, physical locations.

Once a participant successfully locates the information needed to answer the first question, he/she is required to enter the information into a database maintained by the scavenger hunt site operator. Only after this answer is verified as correct is the next question/clue set provided to the participant. This is one distinction from currently operating Internet-based scavenger hunts. This process continues until all of the questions have been successfully answered, at which time the participant is congratulated for his/her efforts. Upon conclusion of a game session, prizes may be awarded to successful participants.

The scavenger hunt site operators may ensure that participants actually visit the advertisers'/sponsors' sites by tracking the referring Web sites through which a participant returned to the hosting site to enter an answer. That is, the hosting site operators may provide some guarantee to advertisers that participants will actually be required to visit the advertisers' sites by associating a correct answer not only with a correct response to the question asked, but also with a correct path traversal through the Internet to arrive at a location where the correct information may be found. This is yet another distinction (and an important one from an advertiser's point of view) from the scavenger hunt schemes currently deployed on the Internet. Further, it is this mechanism that will help ensure advertising revenue is derived from the operation of the scavenger hunt site, as advertisers will be willing to pay for the guaranteed click throughs generated by the site.

By awarding prizes and/or other entitlements, participants are attracted to participate in the scavenger hunt. Further, by strategically placing the answers to the questions in specific locations on an advertiser's/sponsor's Internet site (usually several pages deep within the site), participants in the scavenger hunt are required to become very familiar with the material on that specific site. This, in turn, requires the participant to thoroughly read a participating advertiser's site, dramatically increasing the potential impact of advertising that is contained on that site.

Although discussed with reference to certain illustrated embodiments, upon review of this specification, those of ordinary skill in the art will recognize that the present advertising scheme may find application in a variety of systems, perhaps with one or more minor variations. Therefore, in the following description the illustrated embodiments should be regarded as exemplary only and should not be deemed to be limiting in scope. Further, it should be kept in mind that some portions of the detailed description that follows are presented in terms of algorithms and symbolic representations (e.g., through the use of flow diagrams, etc.) of operations on data within a computer memory. These algorithmic descriptions and representations are the means used by those skilled in the computer science arts to most effectively convey the substance of their work to others skilled in the art.

An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared and otherwise manipulated. It has proven convenient at times, principally for reasons of common usage, to refer to these signals as bits, values, elements, symbols, characters, terms, numbers or the like. It should be borne in mind, however, that all of these and similar terms are to be associated with the appropriate physical quantities and are merely convenient labels applied to these quantities.

Moreover, unless specifically stated otherwise, it will be appreciated that throughout the description of the present advertising scheme, use of terms such as "processing", "computing, "calculating", "determining", "displaying", "rendering" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices. Again, these are the terms and descriptions commonly used by and among practitioners of ordinary skill in the relevant arts.

To better understand and appreciate some of the terms and concepts involved in the present scheme, some background is appropriate, starting with the Internet. The Internet is a vast and expanding network of networks of computers and other devices linked together by various telecommunications media, enabling all these computers and other devices to exchange and share data. Sites on the Internet provide information about a myriad of corporations and products, as well as educational, research and entertainment information and services. An estimated 30 million people worldwide use the Internet today, with 100 million predicted to be on the "net" in a matter of years.

A computer or resource that is attached to the Internet is often referred to as a "host." Examples of such resources include conventional computer systems that are made up of one or more processors, associated memory (typically volatile and non-volatile) and other storage devices and peripherals that allow for connection to the Internet or other networks (e.g., modems, network interfaces and the like). The precise hardware configuration of the hosting resource is generally not critical to the present invention, nor are the precise algorithms used to implement the services and methods described herein. Instead, the focus is on the nature of the services provided by and through the hosting resource.

In most cases, the hosting resource may be embodied as hardware and/or software components of a server or other computer system that includes an interface module, which allows for some dialog with users thereof (e.g., participants in the scavenger hunt), and that may process information through the submission of Web forms completed by these users. Generally, such a server will be accessed through the Internet (e.g., via Web browsers) in the conventional fashion. Operating in conjunction with the interface module may be a communication interface that supports the distribution of electronic mail (e-mail) messages to or from other Web sites or users.

In order to facilitate communications between hosts, each host has a numerical Internet protocol (IP) address. The IP address is made up of four groups of numbers separated by decimals. For example, the IP address of a hypothetical host computer might be 123.456.78.91. Each host also has a unique "fully qualified domain name." Each "fully qualified domain name" is unique throughout the Internet. In the case of the hypothetical host 123.456.78.91, the "fully qualified domain name" might be "computer.domain.com".

In its most generic form, a fully qualified domain name consists of three elements. Taking "computer.host.com" as an example, the three elements are the hostname ("computer"), a domain name ("domain") and a top level domain ("com"). A given host looks up the IP addresses of other hosts on the Internet through a system known as domain name service.

Domain name service is accomplished as follows: The Internet is divided into several "top level" domains. For example, ".edu" is a domain reserved for educational institutions, ".gov" is a domain reserved for government entities and ".net" is generally reserved for enterprises operating within the Internet. Although ".com" is short for "commercial," it is a catchall domain and is today the most popular one generally available to Internet users that have no special attributes, i.e., those that are not a school, a government office or an Internet-based enterprise. Each domain name active in a given top-level domain is registered with the top-level server which contains certain hostname and IP address information.

As previously indicated, in order to access the Internet most users rely on computer programs known as "Web browsers." Commercially available Web browsers include such well-known programs as Netscape's Navigator™ and Communicator™ and Microsoft's Internet Explorer™. If an Internet user desires to establish a connection with a Web page hosted at computer.domain.com, the Internet user might enter into a Web browser program the URL (or Web address) "http: www.domain.com". The first element of the URL is a transfer protocol (most commonly, "http" standing for hypertext transfer protocol, but others include "mailto" for electronic mail, "ftp" for file transfer protocol, and "nntp" for network news transfer protocol). The remaining elements of this URL (in this case, "www" standing for World Wide Web—the Internet's graphical user interface—and "domain.com") are an alias for the fully qualified domain name of the host computer.domain.com.

Once a URL is entered into the browser, the corresponding IP address is looked up in a process facilitated by a top-level server. In other words, all queries for addresses are routed to certain computers, the so-called top-level servers. The top-level server matches the domain name to an IP address of a domain name server capable of directing the inquiry to the computer hosting the Web page. Thus, domain name service ultimately matches an alphanumeric name such as www.domain.com with its numeric IP address 123.456.78.91.

One way advertisers and others establish a presence on the Internet is by creating a Web page, which is, ultimately, a computer data file on a host operating a Web server within a given domain name. When the Web server receives an inquiry from a user through the Internet, it returns the Web page data in the file to the computer making the inquiry. The Web page may be a single line or multiple pages of information and may include any message, name, word, sound or picture, or combination of such elements. Most Web browsers will show somewhere on the screen the domain name of the Web page being shown and will automatically include the domain name in any printout of the Web page (see e.g., the above described FIGS. 2A–2J). There is no technical connection or relationship between a domain name and the contents of the corresponding Web page.

There are a number of ways for an Internet user to find a Web page. Web browsers feature access to various indexes, commonly referred to as search engines. Well-known indexes include InfoSeek™ Guide, Lycos™, ExCite™ and Yahoo™. These indexes will allow the user to enter a name or a word or a combination of words, and will return the results of the search as a list of "hyperlinks" to Web pages that have information within or associated with the document making up the page responding to the search.

A hyperlink is a link from one site on the Internet to a second site on the Internet. "Clicking" (or, more generally, selecting using a cursor control device such as a mouse, joystick, touch pad, etc.) on a designated space on the initial site which references the subsequent site by a picture, highlighted text or some other indication will direct the user's browser from the initial site to the second site. In addition to their use in indexes, hyperlinks are commonly placed on Web pages, thus allowing Internet users to move from Web page to Web page at the click of a button, without having to type in URLs. Hyperlinks are also used to initiate the transfer of files or other information from the hosting resource to the user's computer in a process commonly known as downloading.

Hyperlinks can be and commonly are established without reference to the domain name of the second site. A hyperlink is not technically related to a domain name and therefore it can be identical to an existing domain name without conflicting with that domain name. For example, were the operator of a Web page known as SITE to establish a home page at http: www.xyz.com, any number of indexes could be employed and hyperlinks could be established to bring up the page through use of the word SITE.

As alluded to above, users commonly interact with Internet-based hosts through the submission of Web forms. In general, a Web form is a collection of form fields displayed as a Web page by a browser in response to hypertext mark-up language (HTML) tags and other information received from a Web server. An associated form handler resides at the server to collect and process the information submitted by a user via the form. By using such forms, an information collection process performed by a host is made interactive with the users thereof. That is, users can add text to text boxes, select from drop down menus and/or select check boxes and/or radio buttons, etc. Typically, the user submits the form by clicking on a submit button or other appropriately labeled element of the form and, upon such submission, the contents of the form are passed to the form handler. Depending upon the type of information being submitted and the type of form handler being used, the information submitted by a user may be appended to a file maintained by the host, for example a file associated with a temporary account assigned to the user or a larger database. In this way information may be collected, processed and displayed to those who access it.

A text box is a standard form field into which a user can type text. When a form containing a text box is submitted in a Web browser, the name and contents of the text box are provided to the form handler running on the server. A check box field is typically arranged in a grid or matrix fashion with one or more cells of the matrix including a check box. Check box fields present a user with choices that can be made by clicking (e.g., selecting or deselecting as appropriate) a check box. Such fields are created and rendered using programming techniques common in the art and any number (including all or none) of individual check boxes may be selected or not. When a user submits a form containing a check box field, the name of each check box along with its value is provided to the form handler at the host. Radio button fields present a user with a choice that can be made by selecting a button. Radio buttons are displayed in a set, only one of which may be selected at a time. When radio button fields are created, they are assigned a group name, and each button in the group is assigned a value and an initial state (selected or not selected). When the user selects one of the buttons in the field, all other buttons in the field take on a value of not selected. Then, when the user submits the form, the group name and value of the buttons is provided to the corresponding form handler at the server for processing.

One other Internet feature to be recognized is the "cookie". A cookie is a (usually) small file (often a text file) passed to a client (e.g., a web browser) by a server that contains information that can be retrieved by the server at a later time (e.g., during a subsequent visit to a Web site). Cookies are set (i.e., stored on a user's computer system) in response to a command line in the HTML of a document accessed by the user's browser. An example of some script used to set a cookie, might read: "Set-Cookie: NAME=VALUE; expires=DATE; path=PATH; domain=DOMAIN_NAME; secure". Cookies are often run from common gateway interface scripts, but they can also be set or read by Javascript. Cookies are also referred to as Persistent Client-Side State Objects.

Thus, cookie files contain information a site can use to track such things as passwords, lists of pages visited, and the date when a certain page was last viewed. Cookies might also contain information such as login or registration information, online "shopping cart" information, user preferences, etc. An example of the later category might be a cookie that is set when a user fills out a form stating his or her preferences while visiting a particular Web site. Then, the next time the user visits the same Web site, the associated server can read the user's preferences from the stored cookie, and customize the appearance of the Web site according to the previously defined preferences.

Cookies are usually set to expire after a predetermined amount of time and are usually saved in memory until the browser software is closed down, at which time they may be saved to disk if their "expire time" has not been reached.

Figure 3:
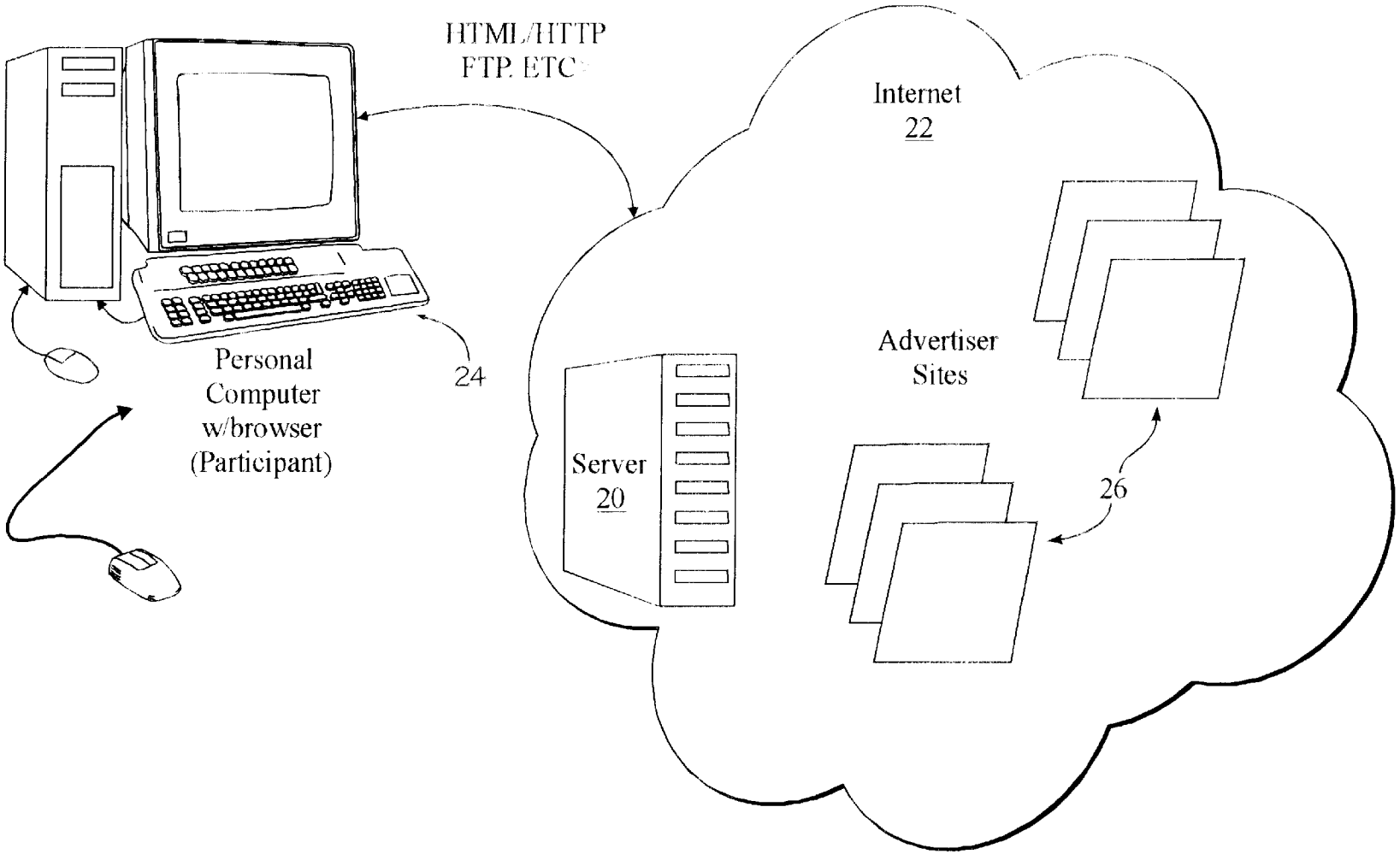
FIG. 3 illustrates the interconnection of a scavenger hunt participant's personal computer system to the internet, allowing communication with a computer-based resource hosting the present scavenger hunt advertising model.

With this background in mind, the discussion turns now to some of the features and advantages of the present advertising scheme. Shown in FIG. 3 are the basic elements associated with the use and operation of the present Internet-based scavenger hunt advertising model. The scavenger hunt site provider will typically establish a hosting resource, such as server 20, so that it is accessible through the Internet 22. That is, prospective participants (as well as sponsors) can reach server 20 through the use of a personal computer system 24 (which may be a desk top computer system, a notebook computer, a work station, a web clipping device or any other suitable computer system) having a browser or other similar software and being connected to the internet 22 in the conventional fashion. Dialogs between personal computer 24 and server 22 (examples of which are presented below) may be conducted using HTML/HTTP, FTP or other communication protocols common in the computer arts.

Various advertiser/sponsor sites 26 are also accessible through the Internet. Usually, these advertiser sites 26 are hosted on resources other than server 22, although in some cases server 22 may host one or more sponsor/advertiser sites. The advertiser sites 22 are conventional Web sites with the exception that they are configured to allow a game participant to return to the scavenger hunt through the selection of a hyperlink (which in many cases will be hidden somewhere within the advertiser site). This redirection of a participant from an advertiser site back to the game site is explored further below.

Figure 4:
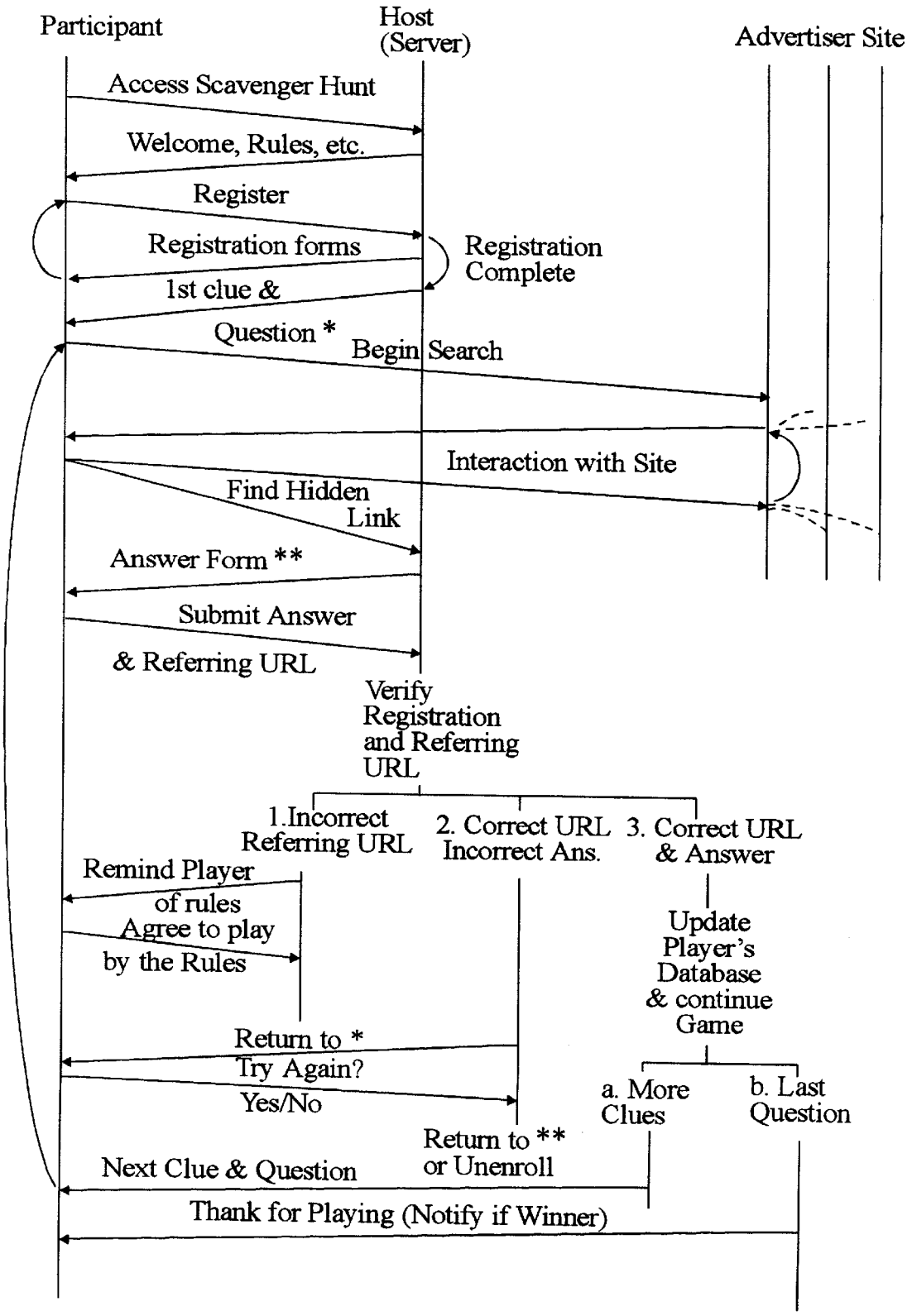
FIG. 4 illustrates an example of a dialog between a scavenger hunt participant, hosting resource and one or more advertiser sites as might take place during a scavenger hunt organized in accordance with an embodiment of the present advertising scheme.

Now referring to FIG. 4, the basic dialogs between participants, the game site and various advertiser sites is described. At the outset, a prospective participant is attracted to the hosting site (e.g., the scavenger hunt game site hosted at server 20) through referrals from others, attractive advertising displayed in the physical and/or virtual world, and/or attractive content made available at the game site (of course, in some cases a prospective participant may simply find the site by browsing the Internet or by specifically searching for such a site). Upon accessing the game site, the user is presented with a welcoming screen, perhaps similar to that used by internettreasurehunt.com and described above. The precise format or layout of the welcoming screen (or indeed any of the screens to be discussed herein) is not critical to the present invention, rather it merely serves as an interface to acquaint the participant with the game site, to explain the rules of the scavenger hunt and/or to provide the participant with a chance to register for participation in the game.

Assuming the user wants to play, he/she is given the opportunity to register. Usually, such registration will involve the completion and submission of one or more Web forms (as was the case with internettreasurehunt.com) that solicit personal, contact and/or other information from the participant. During registration, one or more cookies may be set to store information such as the user's name, passwords, other log-in information, etc. These registration cookies may be used to later determine whether the a participant is a registered participant. Once the registration process is complete, the participant is presented with a first question/clue set to begin the game.

As indicated at the outset of this discussion, one of the distinctions of the present scheme from other Internet-based scavenger hunts is that the present scheme does not provide participants with all of the game questions up front. Rather, participants must "earn" the right to answer subsequent questions by correctly answering preceding questions. Sometimes, a correct answer will require not only that the user submit a correct response to a question, but also that the participant access a point at which such a response can be provided through an authorized path (i.e., from an authorized referring Web site). This is yet a further distinction of the present scavenger hunt scheme from others such as that deployed at internettreasurehunt.com.

To make it possible for participants to correctly answer questions presented to them, the scavenger hunt service provider will often provide "clues" to where the answers may be found. At other times, the question itself may not be initially presented, with only clues to where a proper referring Web site may be found being provided. The goal here is to require participants to truly visit the advertisers' Web sites and to truly read the information at those sites before being able to answer a question.

For example, in one embodiment the introductory question/clue set for a game may inform the participants that the question will be related in some way to a particular book (identified in a clever way, perhaps not readily apparent to all participants). Thus, one clue might suggest that the subject book is sometimes sold by individuals living along a river in South America, and the question is then, "How much could you save if you bought it from the natives?"

With this clue set, a clever participant might realize the answer can be found at Amazon.com©, an Internet-based book store (it is named after a river in South America). By visiting the Amazon.com Web site and searching for the subject book, the participants are required to become familiar with the site in an effort to locate the answer. In other words, it is not enough that clever participants can find the subject advertiser's site, they must actually peruse the site to decipher the answer to the question. This provides some assurance to advertisers/sponsors that advertising monies paid to the scavenger hunt site operators are actually sound investments that will result in at least some Internet users becoming familiar with their sites. Such assurances cannot be had with banner ads.

Ultimately, say a participant selects the title of the subject book (e.g., in response to a search query at the Amazon.com site), whereupon he or she is taken to a page of the site where the book is displayed. Typically at this page will also be reported the amount of money to be saved by purchasing the subject book through Amazon.com (i.e., the answer to the question originally posed). This tends to reiterate the advertising message the game sponsor is seeking to deliver to prospective customers. Then, by clicking on a hidden (or not) hyperlink on that page of the Amazon.com site (e.g., a hyperlink hidden behind an image of the subject book or perhaps prominently displayed on the page if the advertiser so chooses) the participant is returned to the game site.

Upon such return, the hosting resource provides an answer form for use by the participant. Any submission may be checked against the enrollment roster to ensure that the participant answering the question is a registered player. Preferably, the referring URL(s) are also verified before an answer is accepted as correct.

In the event that the referring URL is not correct, the participant is reminded of the requirement that he or she actually visit the advertisers' sites before submitting any responses. If the participant agrees to play by the rules, he or she is returned to the question/clue set page to begin a proper search. In the event the referring URL is correct but the response provided by the participant is incorrect, he or she is given the opportunity to submit a new response or quit the game. Finally, if the participant submits the correct response and did so by following the approved path from a recognized referring URL (of which they may be more than one), he or she is presented with the next answer/clue set and the process repeats. This sort of dialog can continue until all of the questions for a particular game have been answered, at which time a participant may be congratulated for his/her efforts and perhaps later notified (e.g., by electronic mail) at a later time of any prizes won. In other embodiments, the participant may not be provided with an answer submission form until a verification of a proper referring URL is made.

In this particular example the scavenger hunt forced the participant to go to a specific internet site, Amazon.com, use facilities of that site (e.g., a local search engine, etc.), and become familiar with its processes, layout and content. Finally, this process pointed out to the user the potential economic advantages of purchasing a book from the advertiser's site. The ability to transport a user to a specific internet site; gently coerce (without seeming to do so) the user to search, use and thoroughly understand the site; and then deliver (in a subtle and non-intrusive way) an advertising message to that user is a distinct and unique advantage of the present scheme over other advertising models.

Although the fundamental ideas behind the present scheme may seem elementary (especially once they are explained in the fashion set forth above), there are a number of nontrivial details associated therewith. For example, through the use of highly sophisticated Internet-based search engines, it is possible for users to enter information (e.g., using boolean expressions and the like) regarding a clue and have the search engine locate a candidate Web site directly, without having to participate in the scavenger hunt. This would defeat the purpose of the advertising model by allowing a participant to avoid the methodical progression through an advertiser's site that is intended. Indeed, this is one of the failings of the intemettreasurehunt.com scheme where all of the questions are set forth at the outset and no requirement for actual site visits exists.

As noted above, the present scheme provides a solution to this problem by requiring that in order for a participant to obtain credit for locating the required information on the Internet, he or she must have been referred to that specific URL from another specific URL. That is to say, even though an individual participant could use a search engine to identify locations at which the subject book of the above example might be found, by using such techniques the participant would not have gotten to the specific Amazon-.com URL without having gone through the search engine on the Amazon.com site. Thus, while the participant would have the correct response to the question posed, he or she would not have come through a recognized path with the proper referring URLs. Thus their answer would be rejected.

More particularly, in preferred implementations of the present advertising scheme when a participant attempts to enter information into an answer database, the referring URL is checked to see if it is an authorized URL. If it is not an authorized URL, the attempted data entry into the database is rejected. In such cases, the participant is reminded of the rules and referred back to the starting point for the associated answer/clue set and provided an opportunity to obtain the information correctly. This ensures that participants cannot bypass the stepwise process through the advertiser/sponsor site that is one of the benefits provided by the present scheme.

Crafty and computer-savvy users may, however, recognize the need for the correct path information as part of their answers (e.g., they may become aware of such a mechanism through attempts to provide answers using the search engine technique described above). Such users will no doubt be aware that some conventional Web sites store such information (i.e., path traversal information) in "cookies" which are often located in a hidden subdirectory on the participant's computer system. These cookies can either be in either clear text or encrypted format and generally contain information regarding the user, date and time of last access, sites accessed, etc. Thus, the crafty computer user might surmise that one or more cookies were being used to store participation information relative to the scavenger hunt, and might recognize that answers to the questions, and therefore the path to the correct to the URLs, could also be so stored. Thus, if such a conventional approach were used to store the present scavenger hunt participation information, these cookies could be easily modified, placed in the hidden directory and used subversively to thwart the game provider's intentions. This would allow a participant to provide seemingly "correct" answers without having actually viewed/visited any of the required materials.

In order to avoid this potential security hazard, the present scheme maintains a secure database of responses on a server or other hosting resource. All participant responses are validated on the client-side using a server-side script, and the results are then stored in the secure database. This prevents the possibility of inappropriate modification or transfer of cookie information. Conventional cookies may be used in this model for the storage of non-critical information such as a participant's password and/or email address (e.g., in an encrypted form). This cookie may be used by a participant to locate his/her registration information should he/she have forgotten it.

Note that upon completion of a game session, there may be more than one successful participants. That is, more than one participant may have successfully completed the scavenger hunt. In such cases, random drawings may be held by the scavenger hunt game service providers to determine how and to whom any prizes should be awarded. This random drawing aspect may tend to discourage participants from publishing or otherwise disseminating the "answers" to the clues/questions and/or the Web paths that must be traversed to attain those answers.

The present advertising model has widespread applicability on the Internet and elsewhere. For example, several modifications can be made to dramatically enhance its value as an advertising model to non-Internet-based businesses. One such modification would involve placing some of the answers or clues outside of the Internet in the physical world. For example, an automobile manufacturer could develop a scavenger hunt designed to inform participants of the various aspects of its automotive assembly process, quality or sales operations. Most of the answers/clues would be directed to Internet sites, with the exception of one or two, which might require a trip to a local automobile dealer.

At the dealer location, the participant might provide a coupon downloaded and printed from the manufacturer's Internet Web site, upon receipt of which the dealer might be required to divulge an answer to the presenting participant. This information could then be taken back to the Internet-based scavenger hunt, entered and the game continued. Thus, advertisers could link advertising on the Internet with advertising in physical space thereby involving and engaging the participant in physical world activities. Additionally, the present advertising model could be extended to involve obtaining answers from books, television programs, CD ROMs, and/or any other source of information outside of the Internet.

The present scheme may also be used to target specific groups of individuals. This is of particular interest to advertisers. For example, if characteristics are known for a specific group of people of a specific age and/or sex, the advertisements and scavenger hunt can be focused to include clues, Internet sites and awards that are attractive to that specific group. As noted above, even further modifications of this variant could involve a trip to a physical world location. For example a record company could sponsor a scavenger hunt that could require viewing music videos on television or even attending a concert by a sponsored musical group in order to answer specific questions. Answers and/or clue sets could be provided within the music video or distributed as coupons at the concert provided by the musical group. Any clues could be used to further advance the participant within the scavenger hunt.

Using modifications such as those discussed above then, the present scavenger hunt advertising platform becomes an all-encompassing advertisement media involving not only the Internet but also physical locations outside the Internet. It can also provide targeted advertising and direct, hands on involvement of the participants, furthering the advertising goals of the sponsors.

Figure 5:
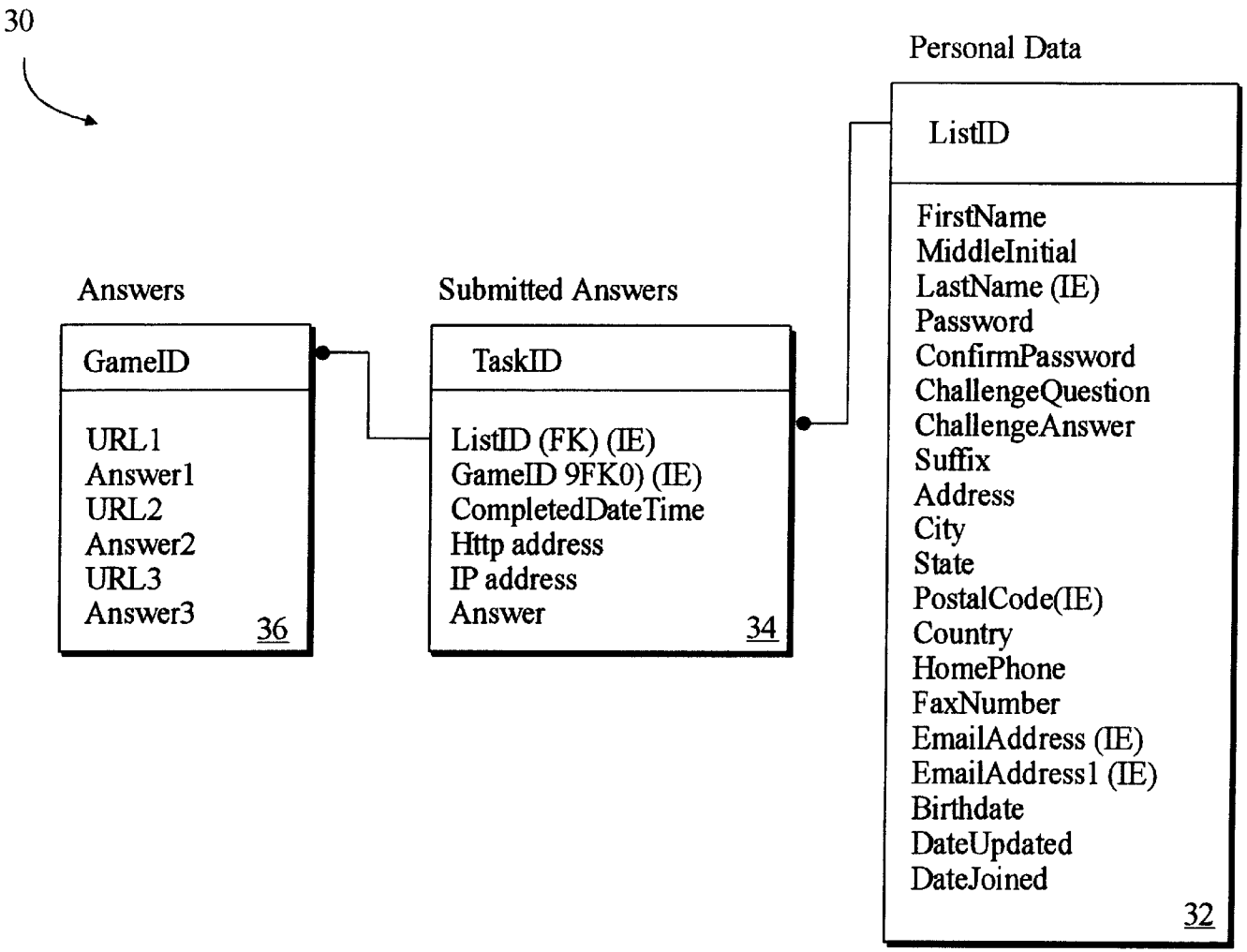
FIG. 5 illustrates an example of a relational database that might be used in an embodiment of the present advertising scheme.

One example of a database structure that might be used by the present scheme (e.g., as part of software package maintained at the hosting resource) is outlined in FIG. 5. This relational database 30 includes three tables 32, 34 and 36. A personal data table 32 contains registration information such as a participant's name, physical world address, e-mail address(s), and password(s). Table 32 may also contain fields for a hint should the participant forget his/her password and fields for one or more questions regarding the hint. Upon registration, a participant is assigned a unique user identifier (ListID) which is also recorded.

A submitted answers table 34, linked with the personal data table 34 through the participant's identifying number, may contain information regarding a current scavenger hunt game (e.g., GameID), including its associated start and/or end dates/times (CompletedDateTime, etc.). Also, this table may include the URL of at least the first Web site where the first game question/clue set (and possibly answer) can be found. This table can be expanded with additional URL locations as needed by the game.

Database 30 also includes an answer table 36, linked with table 34 through the name of the game, with fields for the correct referring URLs and the associated answers for each clue. This table can be expanded as the number of URLs and questions/clues are increased.

During game play, the fields of table 32 are filled in at the time a user registers with the scavenger hunt operator. For example, as part of the registration process, the participant provides name, address, e-mail and password information so that the fields may be filled in. Then, using the unique ID assigned to the participant, a participant-specific table 34 is generated to record the game in which the participant is participating (e.g., if more than one scavenger hunt game is being offered at a time). This table may be automatically provided with the Internet address(es) of the starting point for the scavenger hunt, so that the participant can be directed to the correct starting point. Later, as the participant returns to this starting point through the proper selection of links at advertisers' sites, the participant's answers can be automatically entered in a corresponding participant-specific table 36.

Thus, this database structure allows the scavenger hunt operator to track each participant, record/verify the referring URLs each time the participant returns to submit a response, and the participant's respective answers. For example, as a participant attempts to provide an entry to table 36, the referrring URL and/or answer parameters can be compared to correct/authorized URLs and/or answers for any given day/game to track/update the participant's progress and authorize the furnishing of a next question or congratulatory message at the end of the game.

Figure 6A:
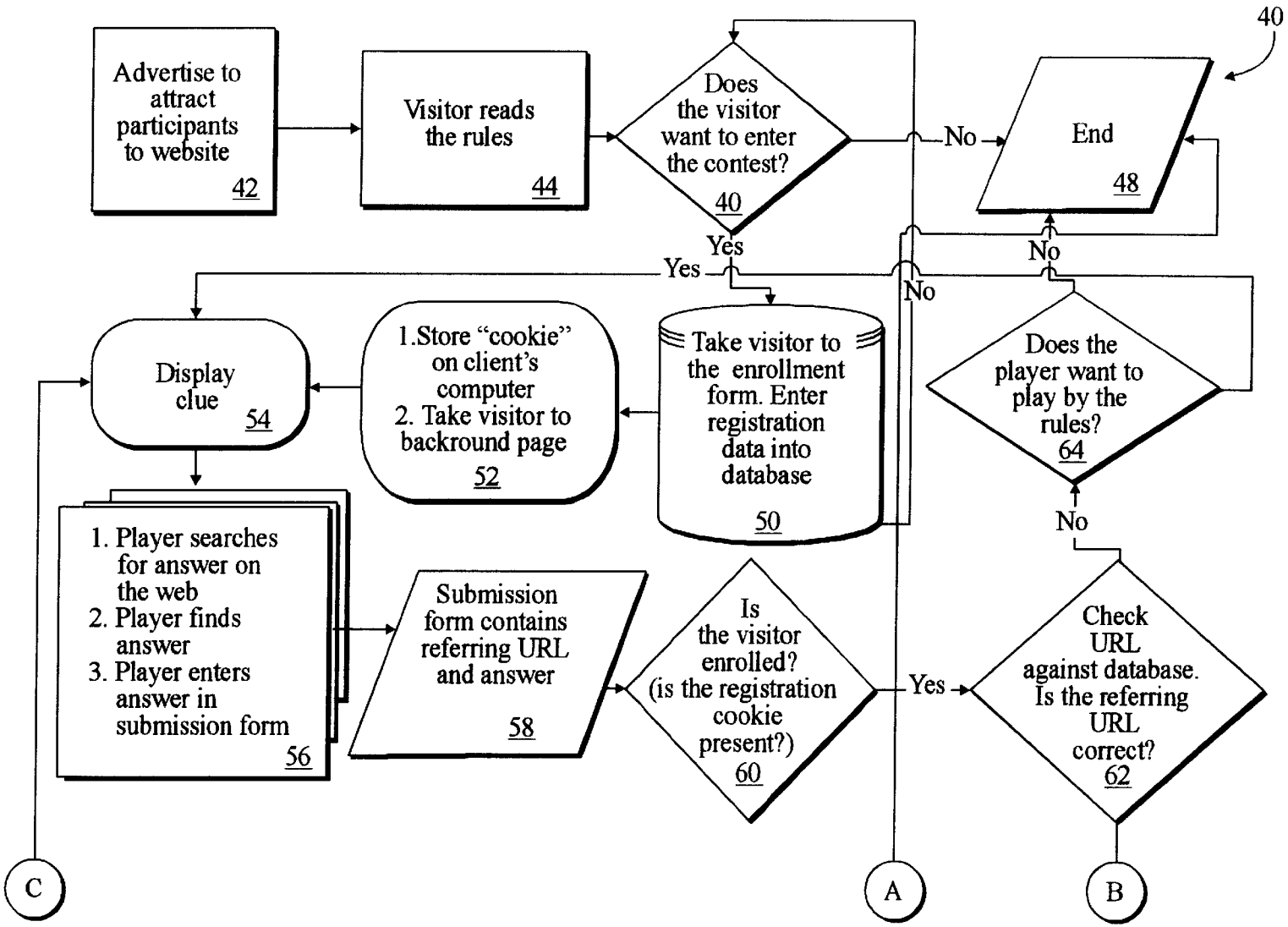
FIG. 6 illustrates an example of a scavenger hunt process in accordance with an embodiment of the present advertising model.
Figure 6B:
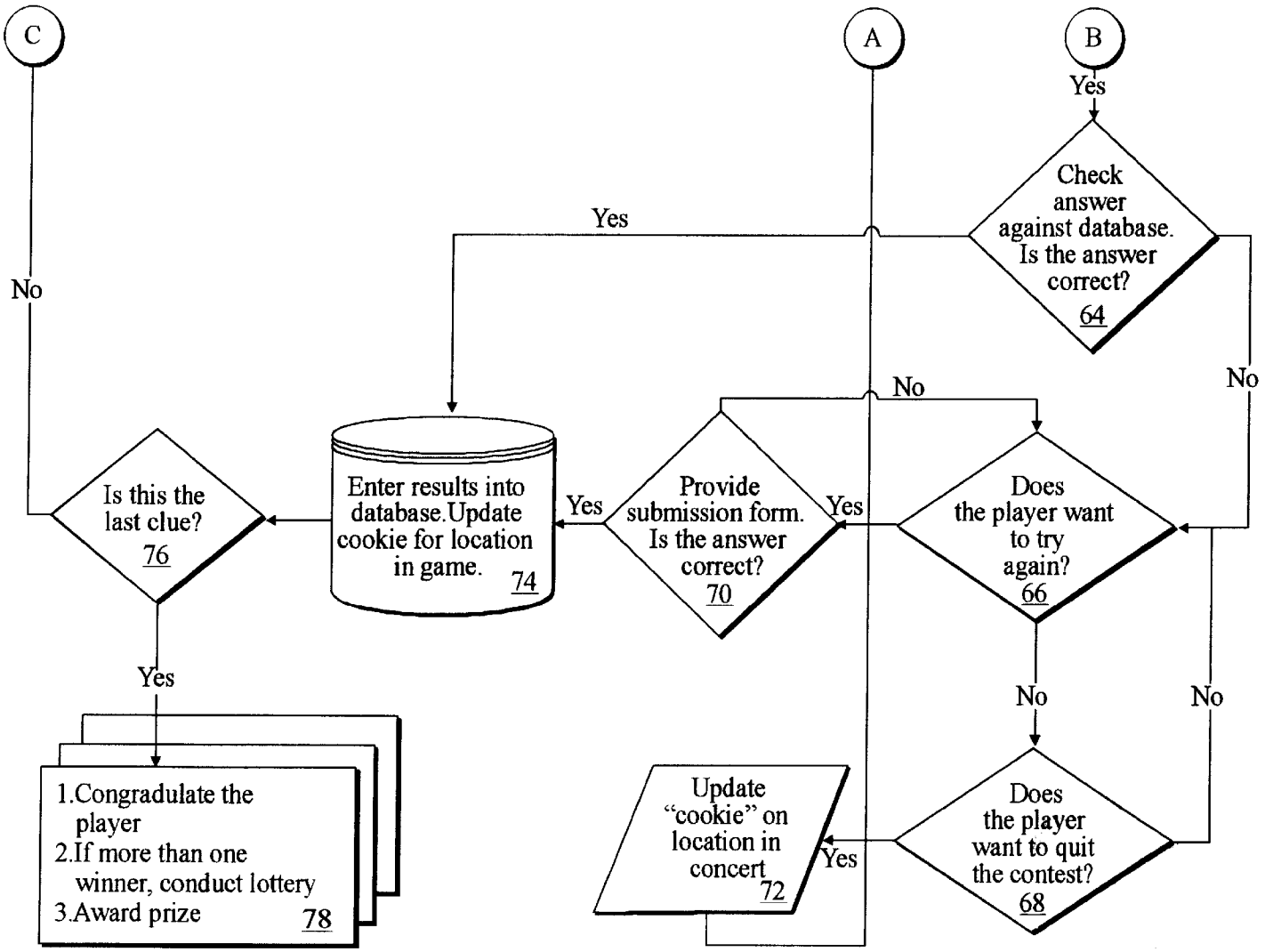

FIG. 6 now illustrates the basic flow of an exemplary scavenger hunt game 40. At an initial step 42, prospective participants (i.e., visitors to the scavenger hunt site) are invited to partake in the scavenger hunt through advertising located on the Internet as well as in other sources widely available to the general public. This includes, but is not limited to television, radio, newsprint, magazines, billboards, fliers, and other modes of advertisement which include the Internet address of the scavenger hunt site. Participation is encouraged and enticed through the use of awards and prizes that can be obtained by successfully completing the scavenger hunt.

When the prospective participants get to the advertised Web address they are invited to click on a highlighted icon, text or graphical image associated with a hyperlink to a Web page that includes a description of the scavenger hunt (step 44). Included here are detailed contest rules outlining the restrictions (including the requirements that participants actually visit the sponsor sites) noted elsewhere in this disclosure. The visitors are then invited to enroll in the scavenger hunt (step 46). If the visitor declines this invitation (step 48), no further action regarding the scavenger hunt game is taken. Otherwise, the registration process may be initiated.

The enrollment or registration process (step 50) may be started by clicking on an icon, text, or other graphic image associated with a hyperlink that takes the new enrollee to a Web page that includes an enrollment information form. By completing and submitting this enrollment information form the participant provides the necessary information for inclusion in the personal data table 32 of the above-described database. At this time, the database may be checked to ensure that there are no duplicate entries or other irregularities. In addition, a server-side script may interact with the enrollee's personal computer to check to make sure that the participant has not already enrolled by looking for a cookie that is stored during the enrollment process.

As shown in the figure, at step 52 the resource that hosts the scavenger hunt Web site stores an enrollment cookie in the designated subdirectory of each enrollee's personal computer. Thus, if such a cookie is found during the enrollment process, the new enrollee is recognized as an existing participant and is denied a repeat entry. Rather, an old enrollment may be re-established.

Assuming no irregularities are encountered, once the enrollment process has been completed, either by finishing a new enrollment or by re-establishing a prior enrollment, the participant is taken to the first page of the scavenger hunt. Here background information regarding the new game is provided along with the first question/clue set (step 54). From this point forward, the participant is on his or her own in finding the relevant information and answer(s) to the first question(s). As indicated above, this search process (step 56) may span over multiple Web sites and/or multiple pages within these sites and may even include visits to physical world locations and events.

Ultimately, the participant locates the link back to the scavenger hunt, after having traversed the approved path to the page containing that link, the participant will submit an answer entry form (step 58). This submission process may involve several sub-events, for example:

1) A check is made to see whether the enrollment cookie is present in the subdirectory of the participant's computer (step 60). This check is made to ensure that any unknowing visitors to the sponsor site that stumbled across the link back to the scavenger hunt site are given the opportunity to become participants in the game. If so, such visitors are allowed to enroll in the game and are taken to the beginning of the scavenger hunt as described in for the original enrollment process.
2) The URL that was the referring URL for the current page (i.e., the page with the link back to the scavenger hunt) is checked to make certain that this URL matches the referring URL for the game located in the database. This checking mechanism is used to make certain that participant got to the current page in the sponsor site through the approved path (step 62). In essence, the referring URL information is used as a security key to allow access to the answer entry database. Unique keys (i.e., unique referring URLs) may be used for each question set.
3) If the correct referring URL is not found (i.e., if there is no match between the referring URL and the correct URL in the database), the participant is routed back to the starting point for the most recent answer/clue set and asked if he/she wants to start over (step 64). A negative answer ends the game for this participant; a positive answer allows the participant to continue from this point.
4) If the enrollment cookie is present and the referring URL is correct (i.e., the referring URL and the URL located in table 36 of database 30 match), then the participant is prompted to answer the question in the supplied form. This answer is then checked against the correct answer in table 36 of database 30 (step 64).
5) If the participant's answer is incorrect, he/she is allowed to either re-enter a new answer (step 66) or to quit the game (step 68). Where a new answer is provided the check and reply process is repeated until a correct answer is entered (step 70). If the participant decides to quit the game, the enrollment cookie is updated to reflect this decision (step 72) and the game is over.
6) Once the participant enters the correct answer, his/her results are updated in the database (step 74) and the enrollment cookie may be updated to reflect this successful completion of a stage in the game. By updating the enrollment cookie for each successful answer, the present scheme can keep track of where the participant is in the game and use this information to rapidly verify referring URLs and answers.

For each correct answer, a check is made to determine whether the participant has successfully completed the game (step 76). Until the participant has successfully completed the game, the above search and answer process is repeated for new question/clue sets. Once all the questions have been correctly answered, the participant is congratulated (step 78) and may be later contacted if he/she is a prizewinner. Preferably, in the event more than one participant successfully completes the game, a random drawing is made to select one or more winners.

Constraints can be placed on the game in terms of its duration. In addition, the game's degree of difficulty can be increased or decreased in by providing harder or easier clues. The game can be made more or less attractive to specific age and sex related groups by altering the awards, prizes or sites involved. Further, the game can also be altered such that it can be offered on a daily, weekly, or monthly basis.

Thus an Internet-based advertising scheme based on a scavenger hunt model has been described. Although the foregoing description and accompanying figures discuss and illustrate specific embodiments, it should be appreciated that the present invention is to be measured only in terms of the claims that follow.

What is claimed is:

1. An Internet-based service configured to operate a scavenger hunt in which participants are required to answer questions using information obtained from one or more Web sites visited in response to hints suggesting where such information may be located, wherein each preceding question must be successfully answered before a next question is presented.

2. The service of claim 1 wherein a correct answer requires verification that a respondent visited the Web site at which the information required in the answer is located.

3. The service of claim 2 wherein a correct answer further requires verification that the respondent reached the Web site at which the information required in the answer is located through an authorized path including at least one predetermined Web address.

4. The service of claim 3 wherein verification that the respondent reached the Web site at which the information required in the answer is located through the authorized path is achieved by using referring uniform resource locator (URL) information regarding the at least one Web address as a security key to allow access to a location at which the respondent may enter the answer.

5. The service of claim 4 wherein the security key provides access to a secure database used to store answers provided by the participants in the scavenger hunt.

6. The service of claim 5 wherein unique security keys for each question used in the scavenger hunt are required to obtain access to the secure database.

7. The service of claim 1 wherein the information required to answer at least one of the questions is obtained from a physical site.

8. An Internet-based resource configured as a host for a multi-participant scavenger hunt in which participants are required to answer questions using information obtained from one or more Web sites visited in response to hints suggesting where such information may be located, wherein each preceding question must be successfully answered before a next question is presented.

9. The Internet-based resource of claim 8 comprising a relational database configured to allow verification that a respondent visited the Web site at which the information required in the answer is located.

10. The Internet-based resource of claim 9 wherein the relational database is further configured to allow verification that the respondent reached the Web site at which the information required in the answer is located through an authorized path including at least one predetermined Web address.

11. The Internet-based resource of claim 10 wherein the relational database is further configured to allow such verification by using referring uniform resource locator (URL) information regarding the at least one Web address as a security key to allow access to a location at which the respondent may enter the answer.

12. A computer-assisted method, comprising verifying an answer to a question posed as part of a scavenger hunt in which participants are required to answer questions using information obtained from one or more Web sites visited in response to hints suggesting where such information may be located, such verification being required to each preceding question before a next question is presented.

13. The method of claim 12 wherein verifying an answer includes confirming that a respondent visited the Web site at which the information required in the answer is located.

14. The method of claim 13 wherein verifying an answer further requires confirming that the respondent reached the Web site at which the information required in the answer is located through an authorized path including at least one predetermined Web address.

15. The method of claim 14 wherein confirming that the respondent reached the Web site at which the information required in the answer is located through the authorized path is achieved by using referring uniform resource locator (URL) information regarding the at least one Web address as a security key to allow access to a location at which the respondent may enter the answer.

16. The method of claim 15 wherein the security key provides access to a secure database used to store answers provided by the participants in the scavenger hunt.

17. The method of claim 12 wherein prospective participants in the scavenger hunt are attracted to a host Web site for the scavenger hunt by providing attractive content at the host Web site.

18. The method of claim 17 wherein the prospective participants are registered prior to participation in the scavenger hunt, such registration including the storing of a unique cookie on each participant's computer system.

19. The method of claim 18 wherein each cookie includes information that allows the host Web site to identify an associated participant's computer system upon accessing the host Web site.

20. The method of claim 19 wherein verifying an answer includes confirming that a respondent visited the Web site at which the information required in the answer is located.

21. The method of claim 20 wherein verifying an answer further requires confirming that the respondent reached the Web site at which the information required in the answer is located through an authorized path including at least one predetermined Web address.

22. A method, comprising deriving revenue from one or more sponsors of an Internet-based service configured to operate a scavenger hunt in which participants are required to answer questions using information obtained from Web sites and/or physical sites associated with the sponsors, wherein a correct answer requires verification that a responding participant actually visited the Web site and/or physical site associated with the question being answered.

23. The method of claim 22 wherein verifying an answer comprises confirming that the responding participant reached the Web site at which the information required in the answer is located through an authorized path including at least one predetermined Web address.

24. The method of claim 23 wherein confirming that the responding participant reached the Web site at which the information required in the answer is located through an authorized path is achieved by using referring uniform resource locator (URL) information regarding the Web site as a security key to allow access to a location at which the respondent may enter the answer.

25. The method of claim 24 wherein the security key provides access to a secure database.

* * * * *